US009046085B2

(12) United States Patent
Schoess et al.

(10) Patent No.: US 9,046,085 B2
(45) Date of Patent: Jun. 2, 2015

(54) MINIATURE PUMPS

(75) Inventors: Jeffrey N. Schoess, Howard Lake, MN (US); Kannan Sivaprakasam, St. Cloud, MN (US)

(73) Assignee: Eden Medical, Inc., Howard Lake, MN (US)

( * ) Notice: Subject to any disclaimer, the term of this patent is extended or adjusted under 35 U.S.C. 154(b) by 257 days.

(21) Appl. No.: 13/601,809

(22) Filed: Aug. 31, 2012

(65) Prior Publication Data

US 2013/0243621 A1 Sep. 19, 2013

Related U.S. Application Data

(60) Provisional application No. 61/610,933, filed on Mar. 14, 2012.

(51) Int. Cl.

| | |
|---|---|
| ***F04B 45/053*** | (2006.01) |
| ***F04B 19/00*** | (2006.01) |
| ***F04B 19/24*** | (2006.01) |
| ***F04B 43/04*** | (2006.01) |
| ***F04B 43/10*** | (2006.01) |

(52) U.S. Cl.

CPC ..... *F04B 19/006* (2013.01); *F04B 19/24* (2013.01); *F04B 43/043* (2013.01); *F04B 43/10* (2013.01)

(58) Field of Classification Search

CPC ..... F04B 19/006; F04B 43/10; F04B 43/043; F04B 19/24

USPC ..... 417/382, 392, 395, 413.1, 413.2; 604/6.11, 65–67; 92/96, 98 R; 606/16; 222/386.5, 394

See application file for complete search history.

(56) References Cited

U.S. PATENT DOCUMENTS

| | | | | |
|---|---|---|---|---|
| 5,792,471 | A * | 8/1998 | Curatolo | 424/480 |
| 6,491,061 | B1 | 12/2002 | Lopez et al. | |
| 2003/0156991 | A1 | 8/2003 | Halas et al. | |
| 2004/0248326 | A1* | 12/2004 | Ziaie et al. | 438/1 |
| 2006/0045766 | A1* | 3/2006 | Harttig et al. | 417/412 |
| 2007/0281024 | A1* | 12/2007 | Lautenbach et al. | 424/473 |
| 2008/0140057 | A1 | 6/2008 | Wood et al. | |
| 2009/0281528 | A1* | 11/2009 | Grovender et al. | 604/892.1 |
| 2010/0183456 | A1 | 7/2010 | Toonder et al. | |

* cited by examiner

*Primary Examiner* — Devon Kramer
*Assistant Examiner* — Stephen Mick
(74) *Attorney, Agent, or Firm* — Underwood & Associates, LLC

(57) ABSTRACT

Miniature pumps for dispensing a volume a flowable substance are described. One pump embodiment includes an environmentally-responsive plug layer that can contract in size, e.g., when exposed to an environmental change such as temperature, to allow an activation solution to flow to a layer of expandable material, such as a superporous hydrogel. Expansion of the expandable material urges a diaphragm into a chamber that holds the dispensable fluid, gas, or gel, forcing the fluid, gas or gel out of the pump.

20 Claims, 9 Drawing Sheets

MINIATURE PUMPS

CROSS REFERENCE TO RELATED APPLICATIONS

This application claims priority to and the benefit of U.S. Provisional Patent Application No. 61/610,933, filed on Mar. 14, 2012, the entirety of which is incorporated herein by reference for all purposes.

STATEMENT REGARDING FEDERALLY SPONSORED RESEARCH OR DEVELOPMENT

Research and development of the concepts disclosed herein were funded in part by grants from the National Institutes of Health, Grant No. 1R43RR025266-01A2. The United States Government may have certain rights in the claimed invention.

TECHNICAL FIELD

This disclosure relates to miniature pumps. In particular, this disclosure relates to miniature pumps capable of dispensing all or part of a stored liquid, gel, gas, or other medium from a retaining vessel, where the pumping mechanism is driven in part by a swelling action of one or more polymers, in particular, hydrogel polymers.

BACKGROUND

Pumps generally describe devices capable of flowing a liquid, gel, gas, or other flowable medium from one location to another. Pumps generally work by displacing a volume by mechanical action and are available in a variety of configurations for various purposes. For example, some large-scale industrial pumps are able to move large volumes of relatively viscous materials; other types of pumps are capable of transporting minute quantities of liquids with a high degree of accuracy and reliability.

Pumps can be driven by a variety of power sources, including alternating electrical current, engines, or batteries for portable applications. Other pumps, such as sump or well pumps can be driven manually, as known in the arts.

SUMMARY

In one exemplary aspect, a pump is described. The pump includes a first pump body having a chamber for storing a flowable substance and one or more exit ports in fluid communication with the chamber, through which the flowable substance can be dispensed when the pump is activated. The pump further includes a flexible diaphragm sealingly engaged to the first pump body and positioned to retain the flowable substance within the chamber when the pump is in a pre-activation configuration. The pump further includes a layer of absorbent material disposed upon a surface of the diaphragm opposite the chamber. The pump further includes a second pump body sealingly engaged to the first pump body having first and second chambers connected by a porous wall that, when the pump is activated, allows a stored activation fluid to flow from the first chamber through the second chamber, and onto the layer of absorbent material to cause the layer of absorbent material to swell in size. The swelling of the absorbent material can cause the diaphragm to flex into the first pump body chamber and thereby urge the flowable substance toward the one or more exit ports.

In one embodiment, the flowable substance is a liquid, gel, or gas.

In one embodiment, the pump further includes a plug layer disposed within the second chamber of the second pump body, retained therein in part by a porous chamber floor. The plug layer can be configured to substantially prevent the activation fluid from flowing from the first chamber through the second chamber until the pump is activated. In one embodiment, the plug layer includes an environmentally-responsive polymer capable of changing from a first size to a second size in response to one or more environmental stimuli. In one embodiment, the environmental stimulus is one or more of a change in: temperature, pH, pressure, salinity, or ionic strength of the environment within the second chamber, or exposure to radiation. In one embodiment, a change in the temperature can be caused by vibration-induced friction between components of the environmentally-responsive polymer.

In one embodiment, the plug layer includes a hydrogel. In one embodiment, the hydrogel is a plurality of hydrogel beads. In one embodiment, the hydrogel beads are composed of N-isopropylacrylamide.

In one embodiment, the layer of absorbent material includes a superporous hydrogel or superporous hydrogel beads.

In one embodiment, a dispensing rate of the dispensable fluid or gel can be selectably controlled by one or more of: the thickness and material composition of the diaphragm; the reaction rate of the plug layer to the environmental stimuli; or the absorption rate of the activation fluid into the absorbent material.

In one exemplary aspect, a pump for dispensing a stored fluid, gas or gel is described. The pump includes a pump body having a first fluid-retaining chamber for retaining the stored fluid, gas or gel, which is defined by one or more inner walls, a floor adjacent to said one or more inner walls, and a flexible diaphragm. The flexible diaphragm is capable of extending into the fluid retaining chamber under an urging force provided by expansion of an absorbent material layer disposed on a surface of the diaphragm opposite the fluid-retaining chamber. Expansion of the absorbent material layer can cause the fluid, gas or gel to be dispensed from the pump body through one or more exit channels that extend from the chamber to an exterior portion of the pump body. The pump further includes a pump activator. The pump activator includes an activation solution contained in a storage chamber that is capable of causing the absorbent material layer to expand in volume when received and absorbed by the absorbent material layer, and a plug layer interposed between the storage chamber and said absorbent material layer capable of substantially preventing the activation solution from contacting the absorbent material layer under a first environmental condition, and allowing the activation solution to flow to the absorbent material layer under a second, different environmental condition.

In one embodiment, the environmental condition is one or more of temperature, pH, pressure, ionic strength, salinity, or exposure to electromagnetic radiation.

In one embodiment, the plug layer includes a plurality of hydrogel beads. In one embodiment, the storage chamber and the absorbent material layer are interposed by a porous wall having pores that are smaller in diameter than the mean diameter of the hydrogel beads.

In one embodiment, the hydrogel beads are composed of N-isopropylacrylamide.

In one embodiment, the absorbent material layer is composed of a superporous hydrogel or includes superporous hydrogel beads.

In one embodiment, the fluid, gas or gel includes an effective dose of a therapeutic agent for treating an illness or disease, or cleansing a wound or surgical site.

In one embodiment, the fluid, gas or gel includes or one or more polymeric solutions for the positioning or separation of animal tissue.

In one exemplary aspect, a method for dispensing a fluid, gas or gel from a pump is described. The method includes providing a pump, wherein the pump includes a first pump body having a chamber for storing a flowable substance and one or more exit ports in fluid communication with the chamber, through which the flowable substance can be dispensed when the pump is activated. The pump further includes a flexible diaphragm sealingly engaged to the first pump body and positioned to retain the flowable substance within the chamber when the pump is in a pre-activation configuration. The pump further includes a layer of absorbent material disposed upon a surface of the diaphragm opposite the chamber. The pump further includes a second pump body sealingly engaged to the first pump body having first and second chambers connected by a porous wall that, when the pump is activated, allows a stored activation fluid to flow from the first chamber through the second chamber, and onto the layer of absorbent material to cause the layer of absorbent material to swell in size. The swelling of the absorbent material causes the diaphragm to flex into the first pump body chamber and thereby urge the flowable substance toward the one or more exit ports. The method further includes exposing the plug layer to an environmental condition sufficient to cause the plug layer to shift from a first fluid-blocking configuration to a second fluid-flowing configuration that allows the activation fluid to flow from the storage chamber to the absorbent material layer, to cause the absorbent layer to swell and thereby urge the fluid, gas or gel out of said first fluid-retaining chamber.

Certain advantages of the systems and methods described herein include, in one or more pump embodiments, the ability to dispense fluids, gasses, or gels from a storage container to a chosen location absent of a "traditional" external power source such as a battery or alternating current. Another advantage includes, in a pump embodiment, the ability to selectively expel or dispense a liquid or gel from a retaining vessel to a chosen location through the application of heat to the general surroundings of the pump. Another advantage includes, in a pump embodiment, an inexpensive, disposable pump having no moving mechanical parts, e.g., gears, or pistons, required to transport a retained volume of fluid from a storage vessel to a chosen location. Another advantage includes the capability of wearing a lightweight, small, portable pump on a human or animal body, or implanted in a human or animal body for various applications, including the treatment of disease or ailment, among others.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings in which like references indicate similar elements, and in which.

DETAILED DESCRIPTION OF ILLUSTRATIVE EMBODIMENTS

In one exemplary aspect, pumps are described that are capable of controllably flowing a stored medium, e.g., a liquid, gel, or gas, from a retaining tub, bin, capsule, or other type of container upon application of an external stimulus to the pump. External stimuli can include, without limitation, application of: heat or cold, magnetic fields, vibration, light energy, exposure to changes in pH or salinity, or other stimuli. Thus, in the description that follows, such pumps can be selectively activated without the need for an external power source such as a battery or electrical current from an outlet source.

Figure 1A:
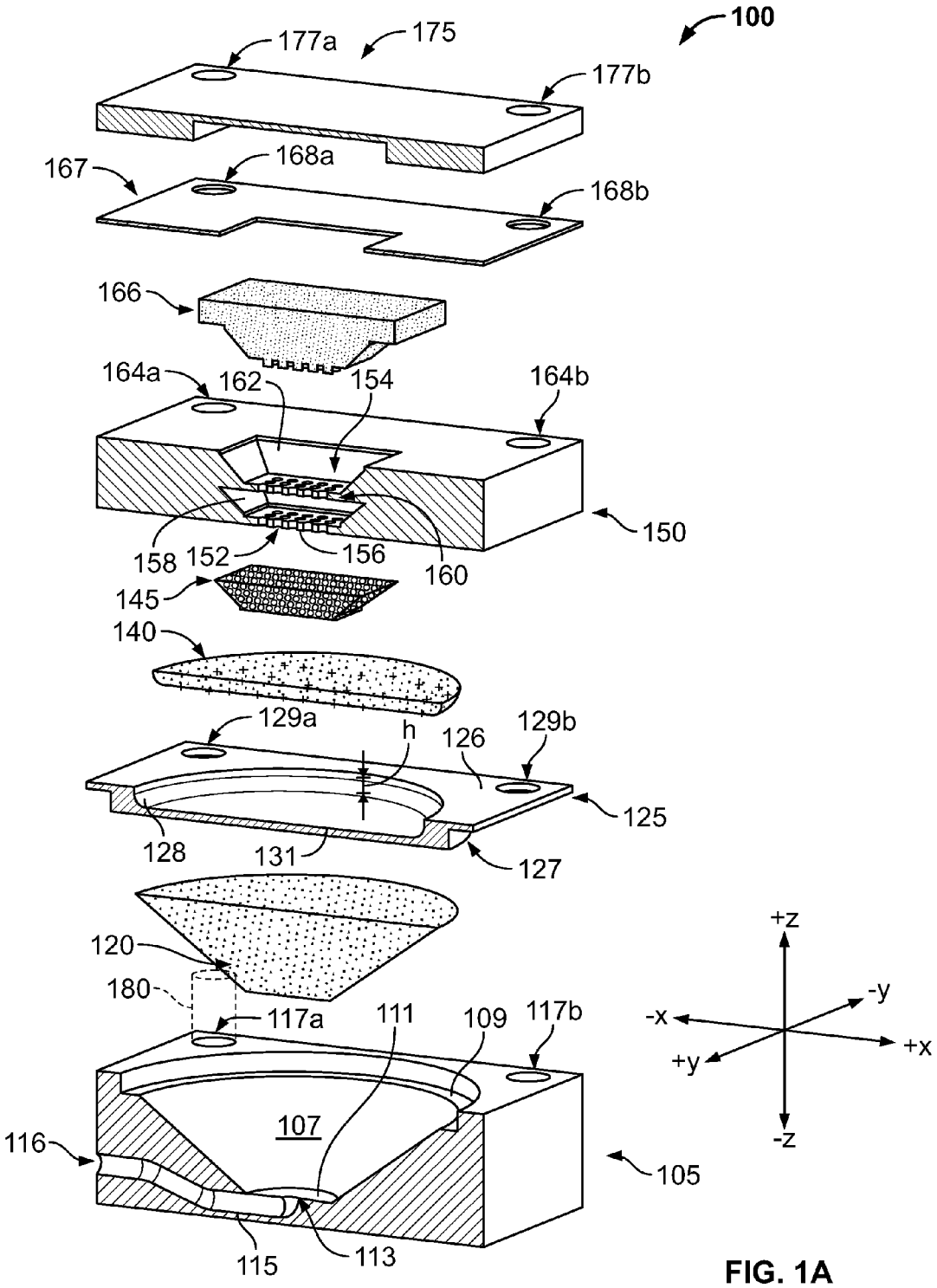
FIG. 1A is a half-section, exploded-view of a pump, according to one embodiment.
Figure 1B:
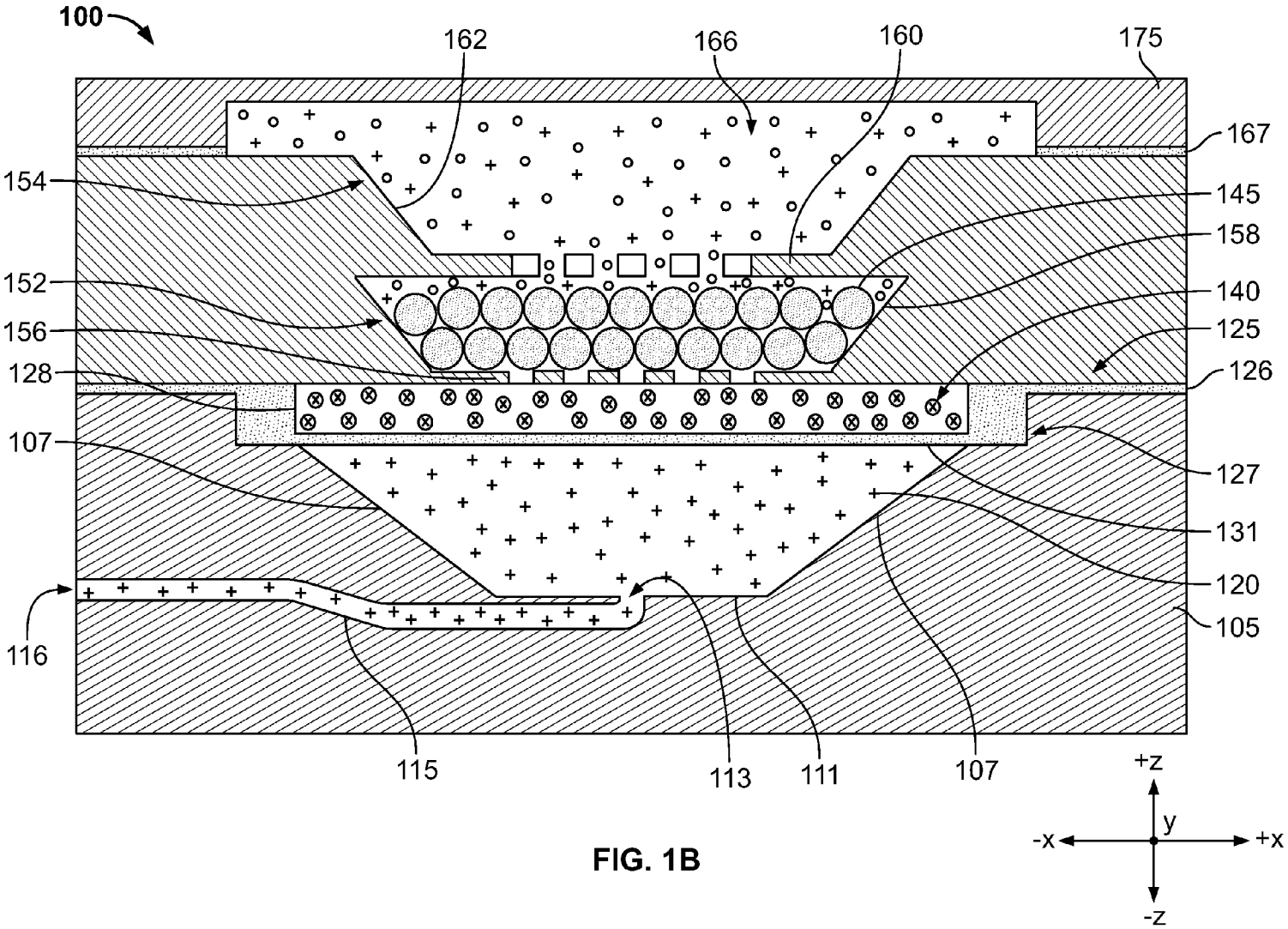
FIG. 1B is a cross-sectional view of the assembled pump shown in FIG. 1A, according to one embodiment.

FIGS. 1A and 1B illustrate a pump 100 according to one embodiment. FIG. 1A is a half-section, exploded-view of the pump 100 shown divided through the x-z plane. FIG. 1B illustrates the pump 100 in an operative, assembled configuration, according to one embodiment. Throughout the following description, like references in FIGS. 1A and 1B indicate similar elements.

In this embodiment, the pump 100 includes a lower pump body 105. The lower pump body 105 includes an inner wall 107 that defines a substantially conical-shaped cavity within the interior of the lower pump body 105 as shown. In this embodiment, the lower pump body 105 is composed of poly (methyl methacrylate) (PMMA), however, other suitable materials can be substituted according to preference. In this embodiment, a disc-shaped floor 111 abuts the inner wall 107 and defines a base of the substantially conical-shaped cavity. The floor 111 includes an aperture 113 that defines one end of a hollow passage 115; the passage 115 is a conduit for transmitting a dispensable fluid 120 from the conical-shaped cavity to an exterior outlet port 116. While reference is made to "fluid" in the description of this and other embodiments, it will be understood that fluids, gels, gasses, and other materials capable of being flowed are equally contemplated, even though they may be classified as other than fluids in the strictest scientific interpretations.

In this and other embodiments, the dispensable fluid 120 can be any substance capable of being flowed from one location (e.g., the conical-shaped cavity) to another location (e.g., to the exterior outlet port 116), including, but not limited to fluids, gels, and gasses. For instance, the dispensable fluid 120 can be a solution that includes one or more therapeutic dose(s) of: a pharmacological agent; an antibiotic; a solution containing one or more compounds for treating wounds, ailments, or other afflictions; a sealant; a solution for irrigating or flushing exudates or neurotic tissue, or other therapeutic solutions. The dispensable fluid can be, e.g., a gel, including therapeutic gels; an oil; a hydrocarbon or a derivative thereof; a chemotherapeutic agent that includes a platelet-derived growth factor fluid to stimulate blood vessel formation and tissue cell growth; a saline solution; water; or other fluids, gels, or gasses. In some cases, the surfaces of the conical-shaped cavity, e.g., inner wall 107, floor 111, etc., can be coated with materials to prevent reaction of the dispensable fluid 120 with the lower pump body 105 material composition.

In this and other embodiments, the dispensable fluid 120 can be a fluid for positioning or separation of internal tissues in an animal subject, such as a viscous polymer or polysaccharide solution. In one example of such an embodiment, the dispensable fluid 120 can be formulated to reduce the likelihood of pre- or post-surgical adhesions in reproductive system tissues, abdominal and bowel tissues, ophthalmic tissues, or skeletal joint and muscle tissues. In another example, the dispensable fluid 120 can be a fluid formulated to reduce the likelihood of tendons binding to tendon sheathes, which can be found, for example, within the physiology of the human hand. In another example, the dispensable fluid 120 can be a fluid formulated to position ophthalmic tissues and maintain those positions during tissue healing; one such fluid is described in U.S. Pat. No. 5,207,660, filed Apr. 26, 1991 to Harvey A. Lincoff, entitled "Method for Delivery of Compositions to Ocular Tissues," which is incorporated by reference herein in its entirety for all purposes. In yet another example, the dispensable fluid 120 can be a fluid formulated to coat tissue such as bladder tissue in an animal subject, to treat or reduce the likelihood of interstitial cystitis. Those skilled in the art will appreciate that other dispensable fluids 120 can be used according to an intended application of the pump 100.

In this and other embodiments, a plug, one-way valve, or other flow-restriction device (not shown in FIG. 1A or 1B) can be used for preventing the dispensable fluid 120 from flowing out of the lower pump body 105 prior to activation of the pump, which is described in greater detail below. In some embodiments, the aperture 113 can lead to an exit port (e.g., the exit port 213 shown in FIG. 2) that allows the dispensable fluid 120 to exit the lower pump body 105 directly, e.g., through a vertical bore (not shown in FIG. 1A or 1B). In such cases the lower pump body 105 can be configured to include attachment mechanisms for receiving a tube or other or lumen-like structure capable of carrying the dispensable fluid 120 from the pump 100. In other such cases, the vertical bore can include interior threads for receiving an end portion of a tube or other fluid-carrying structure having complimentary exterior threads; thus, the end portion of the tube can be screwed into the vertical bore to create a reversible union therebetween. In one embodiment, the vertical bore can be configured as a plunger and configured to receive an extender tube. The extender tube can carry the dispensable fluid 120 from the pump 100 to a chosen location. For example, the extender tube can include a distal tapered nozzle end portion configured to be inserted into tissue, a hydrocolloid dressing or wafer, an object intended to be lubricated by the dispensable fluid 120, or a fluid port.

In this embodiment, the lower pump body 105 includes bores 117*a*, 117*b* configured to receive a portion of a fastener that couples other parts of the pump together, as described in greater detail below (other bores may be included on the portion of the lower pump body 105 not illustrated in FIG. 1A or 1B). Exemplary fasteners include, but are not limited to: bolts, clamps, couplings, dowels, screws, such as machine screws, pop rivets, and other fasteners known in the art. In other embodiments, the components of the pump can be assembled and secured into place using glues, cements, or other adhesives.

In this embodiment, the top of the inner wall 107, i.e., the portion of the wall 107 where the circular diameter is greatest in the x-y plane is adjacent to a surrounding platform portion 109 that is configured to sealingly engage with a complimentary shoulder 127 of a flange member 125 (described in greater detail below). The sealing engagement between the platform portion 109 and the flange member 125 caps the conical-shaped portion and can provide the capability for storing the dispensable fluid 120 within the lower pump body 105.

In this embodiment, the pump 100 further includes a flange member 125. The flange member 125 includes the aforementioned shoulder 127, which generally protrudes downwardly (in the −z direction, as shown) from a top surface 126 to sealingly engage with the platform portion 109 of the lower pump body 105. The flange member 125 further includes apertures 129*a*, 129*b* configured and positioned so as to overlap with bores 117*a*, 117*b* of the lower pump body 105 when sealingly engaged thereto.

In this embodiment, the shoulder 127 of the flange member 125 supports a disk-shaped, resiliently-flexible diaphragm 131. The diaphragm 131 is generally able to resiliently flex or stretch in +/− z directions according to the frame of reference provided by FIGS. 1A and 1B. During operation of the pump, which is described in greater detail below, the diaphragm 131 can expand, e.g., under applied force, into the conical-shaped cavity of the lower pump body 105, thereby urging the dispensable fluid 120 into the aperture 113 of the hollow passage 115.

In this embodiment, the diaphragm 131 is a flexible elastomeric membrane composed of silicone rubber, although other suitable alternative materials can be substituted according to preference. Suitable alternative membrane compositions include, without limitation: silicone rubber polymer, latex rubber, fluoroelastomers such as Viton™ sold by DuPont Performance Elastomers LLC, perfluoroelastomers, PTFE, polyester, polyethylene, and polyurethane; other flexible membrane materials can be substituted according to preference or for a particular use. The thickness of the diaphragm 131 can be chosen to provide a desired amount of elasticity, which, as explained in greater detail below, can influence the rate and amount of dispensable fluid 120 that is expelled from the pump 100 when the pump is activated. Without wishing to be bound by theory, when the pump 100 is activated, a diaphragm 131 having a higher degree of elasticity can be expected to encroach further and faster into the conical-shaped cavity of the lower pump body 105 than a diaphragm 131 having a lesser degree of elasticity, assuming an equal amount of urging force in both cases.

In this embodiment, a polymer layer 140 occupies a substantially disk-shaped void that is defined in part by the downward (−z direction) protrusion of the shoulder 127 from the plane of the top surface 126 of the flange 125. The empty volume of the substantially disk-shaped void, which can also define the volume of the polymer layer 140 if completely full, is defined in part by the height h of the inner shoulder rim 128; the height h (and thereby the amount of polymer 140 used in various embodiments) can be chosen according to preference and functional considerations as described herein. In general, the polymer layer 140 can include a polymer composition capable of absorbing fluid so as to increase the volume of the polymer layer 140 from a first volume to a second, larger volume. In some embodiments, the polymer can be capable of absorbing fluid to increase the volume of the polymer layer 140 from a first volume to a second, larger volume, and subsequently releasing fluid to return to approximately the first volume. Exemplary polymers for this purpose include, without limitation, the class of polymers generally known as superporous hydrogels (SPH's). SPH polymers or SPH polymer compositions can be applied as a paste, foam layer, or solid layer on the top surface of the diaphragm (e.g., the diaphragm surface proximal to the top surface 126 of the flange 125).

In this and other embodiments, a base hydrogel polymer capable of absorbing water or other solutions (including solution 166 described below) can be synthesized by combining at least one ethylenically-unsaturated hydrophilic monomer, a multi-olefinic crosslinking agent and a strengthening agent, which can occupy the narrow spaces of the base polymer matrix. Exemplary ethylenically-unsaturated hydrophillic monomers for this purpose include acrylamide (AM), sulfopropylacrylate (SPAK) and hydroxyl ethylmethacrylate (HEMA), although other ethylenically-unsaturated hydrophilic monomers can be substituted according to preference or for a particular use. In one example, methylene bisacrylamide (BIS) can be used as a multi-olefinic crosslinking agent, although other crosslinking agents can be used. In a preferred embodiment, the strengtheners are polysaccharides which can include polymers of alginic acid, chitosan, carboxymethylcellulose (and its derivatives), (meth)acrylate derivatives (e.g., methyl, ethyl, butyl), polyacetonitrile (PAN), and natural or synthetic rubber emulsions, although other strengtheners can be used. In one embodiment, a superporous hydrogel has an average pore size between about 100 μm and about 600 μm. In general, and without wishing to be bound by theory, it is believed that the presence of large pores in the SPH can contribute to rapid, large-volume absorption of fluids, which can be advantageous in the operational characteristics of some pump embodiments, e.g., rapid expulsion of the dispensable fluid 120.

Some SPH's and SPH compositions are known to swell when exposed to certain fluids, in some cases increasing their volume by a factor of 50 to 200. Exemplary SPH's that can be used in embodiments described herein, including variations thereof, include the hydrogel compositions described in U.S. Pat. No. 6,271,278 to Kinam Park, filed May 13, 1997; U.S. Pat. No. 6,960,617 to Hossein Omidian et al., filed Apr. 22, 2003; and U.S. Pat. No. 7,988,992 also to Hossein Omidian et al., filed Jul. 6, 2007. U.S. Pat. Nos. 6,271,278, 6,960,617 and 7,988,992 are incorporated by reference herein in their entirety for all purposes.

One exemplary, commercially-available microsphere SPH that can be used in the polymer layer 140 is sold under the Expancel brand (Akzo Nobel, Sundsvall, Sweden). Expancel beads can be on the order of 5-10 μm in diameter at ambient temperature (e.g., room temperature). In one embodiment, a polymer layer 140 can be formed into a malleable paste by mixing Expancel microspheres with glycerin, and screen-printing the resulting paste on to the diaphragm layer. Glycerin can be a preferred mixing agent for supporting the SPH's due to its thermal conductivity characteristics and high boiling point, which can reduce the likelihood of evaporation of the paste.

In this embodiment, the pump 100 further includes an upper pump body 150. The upper pump body 150 includes a lower basket 152 and an upper basket 154, each having a truncated square pyramid shape, as shown, which are defined in part by lower basket interior wall 158 and lower basket floor 156, and upper basket interior wall 162 and upper basket floor 160, respectively. (The other walls defining the truncated square pyramid shape are not labeled in FIG. 1 for clarity.) In this embodiment, the lower (156) and upper (160) floors of the lower (152) and upper (154) baskets are porous to allow an activation solution 166 to flow therethrough when the pump is activated, which is explained in greater detail below.

In this embodiment, a volume of activation solution 166 occupies the void space defined by the upper basket 154, and a plug layer 145 occupies the void space defined by the lower basket 152. The plug layer 145 can keep the activation solution 166 from flowing through the upper floor 160 until the pump is activated. The plug layer 145 can be any material, or a plurality of materials, or a composition, including materials dispersed in suspension media such as gels and the like, that is (are) capable of contracting or expanding in size in response to an environmental stimulus. Examples of environmental stimulus for this and other embodiments include, without limitation: changes in temperature, pH, pressure, e.g., atmospheric pressure, salinity, ionic strength, exposure to selected light frequencies, selected acoustic wave frequencies, magnetic fields, vibration, or other environmental factors. In one embodiment, magnetic nanoparticles can be incorporated into the plug layer 145; application of pulsed magnetic fields can cause rapid movement of the nanoparticles which can result in localized heating so as to increase the temperature of the plug layer 145.

In one example, the plug layer 145 can prevent the solution 166 from entering the lower basket 152 by substantially plugging the pores of the upper basket floor 160 under a first environmental condition (such as a first temperature). Under a second environmental condition, (e.g., a second temperature), one or more constituents of the plug layer 145, e.g., SPH's within the plug layer 145, can contract to allow the solution 166 to drain from the upper basket 154 into the lower basket 152.

In one embodiment, the pump 100 can be activated when an environmental stimulus causes the solution 166 to drain from the upper basket 154, flow through the lower basket 152, and contact the polymer layer 140 to cause expansion of the polymer layer 140. As described herein, expansion of the polymer layer 140 into the conical-shaped void in the lower pump body 105 can cause the dispensable fluid 120 to be expelled from the pump 100, e.g., through the hollow passage 115. In general, the activation solution 166 can be chosen according to user preference or for a particular purpose; however, in a preferred embodiment, the activation solution 166 can be chosen to be maximally absorbed by the polymer layer 140. In one non-limiting example, the activation solution 166 is an aqueous solution. Suitable aqueous solutions include, but are not limited to: deionized water, saline solutions, e.g., 0.9% saline weight by volume, distilled water; or distilled water mixed with a chosen proportion of ethylene glycol. In another non-limiting example, the activation solution 166 is a solution composed of, or containing isopropyl alcohol or silicone oil.

In general, the activation solution 166 can be chosen based on desired operational characteristics and other functional considerations of the pump 100, as physical properties of the activation fluid can affect the operation of the pump 100. For example, the viscosity and density of the activation fluid can affect pump activation response time and other variables, which can be advantageous when designing a pump for a particular purpose. Generally, the dispensing action, e.g., the output flow rate of the pump can be controlled according to the rate at which the plug layer 145 contracts to allow the activation solution 166 to flow therethrough, the rate at which the polymer layer 140 absorbs the activation solution 166, or a combination thereof; however, other factors may also be applicable.

For example, isopropyl alcohol, when used as the activation solution, can be rapidly absorbed into a polymer layer 140 that includes a superporous hydrogel composite (SPHC). In such an example, the SPHC can include a filler agent that contains swellable particles that allow or enhance polymerization and crosslinking of the polymer simultaneously. Exemplary filler agents include, but are not limited to: sodium carboxymethylcellulose (Ac-Di-Sol), cross-linked sodium starch glycolate (e.g., Primojel™ provided by DFE Pharma) and cross-linked polyvinyl pyrrolidone (e.g., Polyvinylpolypyrrolidone (Crospovidone)). The use of isopropyl alcohol as the activation solution 166 with a SPHC polymer layer 140 can lead to rapid dispensing of the fluid 120 (under 1 minute, in some embodiments). In a contrasting example, saline solutions are absorbed more slowly in a SPHC polymer layer 140, which can result in a relatively slower dispensing of the fluid 120. In yet another example, tap water (obtained from a municipal supply from Eden Medical headquarters, Howard Lake, Minn., U.S.A.) was found to cause the most rapid swelling of a SPHC polymer layer 140, leading to the fasted dispensing rate of the fluid 120 and the highest pump output pressure (immediate, after activation, and sustained) of all aqueous solutions tested.

In general, the plug material 145 can be chosen according to preference from materials known in the arts. In one non-limiting example, the plug material is an array of hydrogel beads in sufficient number, e.g., collective volume, to prevent the activation solution 166 from flowing through the upper basket floor 160 until the pump is purposefully activated, which is described in greater detail below. The pore size of the lower (156) and upper (160) floors can be chosen in consideration of the average individual size of the hydrogel beads, so as to reduce the likelihood of the pores becoming plugged by the beads. In a preferred embodiment, the size of the hydrogel beads can be selectively increased or decreased through the control of temperature or other environmental variables. For example, at least one type of thermoresponsive hydrogel bead decreases in size when heated. In other embodiments, hydrogels, including hydrogel beads can be used that undergo a change in size in response to one or more environmental stimuli.

In one embodiment, an environmental stimulus can include causing the collection of hydrogel beads to vibrate with sufficient energy to cause localized frictional heating. This heating can cause the hydrogel bead plug layer to contract or swell in size, depending on the type of hydrogel bead used.

In yet another embodiment, environmental stimulus can include exposing the plug layer to radiation, e.g., electromagnetic radiation. For example, light-sensitive hydrogel beads can be caused to contract or swell in size upon exposure to certain wavelengths of light. Thus, in one pump embodiment, the plug material 145 can include such light-sensitive hydrogel beads, and the pump can be activated by exposing the beads to the proper wavelength of light.

In some pump embodiments, environmental stimulus can be imparted to the plug layer via an input port disposed on the pump body where the plug layer is accessible by, e.g., catheter, syringe, or other device. For example, a pump can be activated by introducing a solution having a certain pH that causes a plug layer 145 to swell or contract according to pH-sensitive hydrogel beads contained therein.

One non-limiting example of a thermoresponsive hydrogel is one composed of N-isopropylacrylamide (NIPAAm). NIPAAm hydrogel beads can be synthesized with low or high initiator and accelerator concentration. One exemplary synthetic sequence for producing NIPAAm hydrogels includes combining 6 mL of N-isopropyl acrylamide (NIPAAm), 6 mL of acrylic acid, 6 mL of N—N'-methylene bisacrylamide (as the cross-linking agent) 1 mL of ammonium persulfate, and 100 μL of tetramethylenediamine. In general, the swelling of NIPAAm hydrogel beads can be relatively fast, compared to other hydrogel bead variants, where the kinetics of the swelling can be controlled in part by varying the density of the cross-linking agent in the material. A process for synthesizing thermosensitive poly(N-isopropylacrylamide) hydrogel beads can be found in "Preparation of poly(N-isopropylacrylamide) hydrogel beads by circulation polymerization," H. Tokuyama and N. Yazaki, Reactive and Functional Polymers," 70(12), December 2010, pp 967-971.

Still referring to FIGS. 1A and 1B, in this embodiment, the pump 100 further includes a gasket 167 which can be sealingly engaged to the upper pump body 150, thereby forming a lid capable of retaining the activation solution 166 in the upper basket 154 together with the plug material 145. The gasket includes apertures 168*a*, 168*b* configured and positioned so as to overlap with bores 164*a*, 164*b* of the upper pump housing 150 when sealingly engaged thereto.

In this embodiment, the pump 100 further includes a cover 175. The cover 175 can be configured to be positionable atop the gasket 167 to provide sealing engagement of the gasket 167 to the upper pump housing 150 through, e.g., applied pressure. The cover 175 includes bores 177*a*, 177*b* configured and positioned so as to overlap with apertures 168*a*, 168*b* of the gasket 167 when sealingly engaged thereto.

In this embodiment, the bores and apertures of the various pump components, e.g., bores 117*a-b* of the lower pump body 105, apertures 129*a-b* of the flange 125, bores 164*a-b* of the upper pump body 150, apertures 168*a-b* of the gasket 167, and bores 177*a-b* of the cover 175 are aligned so that a fastener 180 or fastening mechanism extending from the lower pump body 105 to the cover 175 can be received therethrough, to include the other aforementioned components. Exemplary fasteners include, but are not limited to: bolts, clamps, couplings, dowels, hooks, latches, lugs, nails, pins, rivets, including pop rivets, and screws. FIG. 1A includes a fastener 180, in this example, a dowel, extending from the lower pump body 105 for illustrative purposes. Components of the pump 100 can be fastened together using glues, cements, resins, or other compounds known in the art in lieu of, or in addition to the use of the aforementioned fastening mechanisms.

Certain pump components that provide mechanical strength or support of the pump 100, e.g., the lower pump body 105, flange 125, upper pump body 150, and cover 175 can be composed of bio-compatible polymers, metals, ceramics or other materials according to preference and the indented use of the pump 100. One non-limiting example of a bio-compatible polymer that can be used in this and other embodiments is sold under the MED610 brand, offered by Objet Inc., of Billerica, Mass., USA. In some embodiments, consideration can be given to the thermosensitive or pH-sensitive nature of hydrogel beads, if they are used as a plug material, and the choice of material for the aforementioned pump components can be selected so as to have a desired amount of thermal conductivity.

Figure 2A:
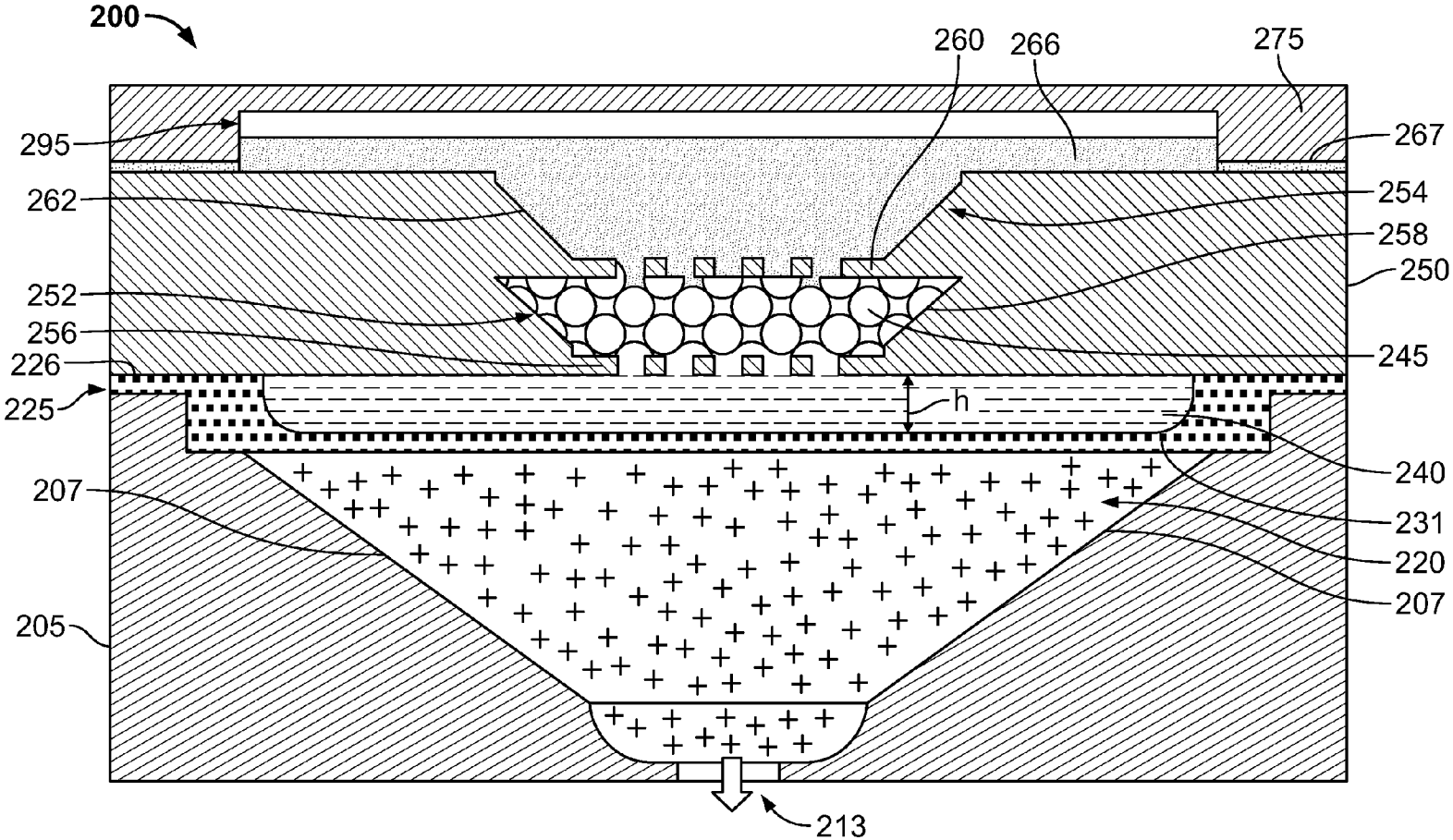
FIG. 2A is a cross-sectional view of a pump in a pre-activated configuration, according to one embodiment.
Figure 2B:
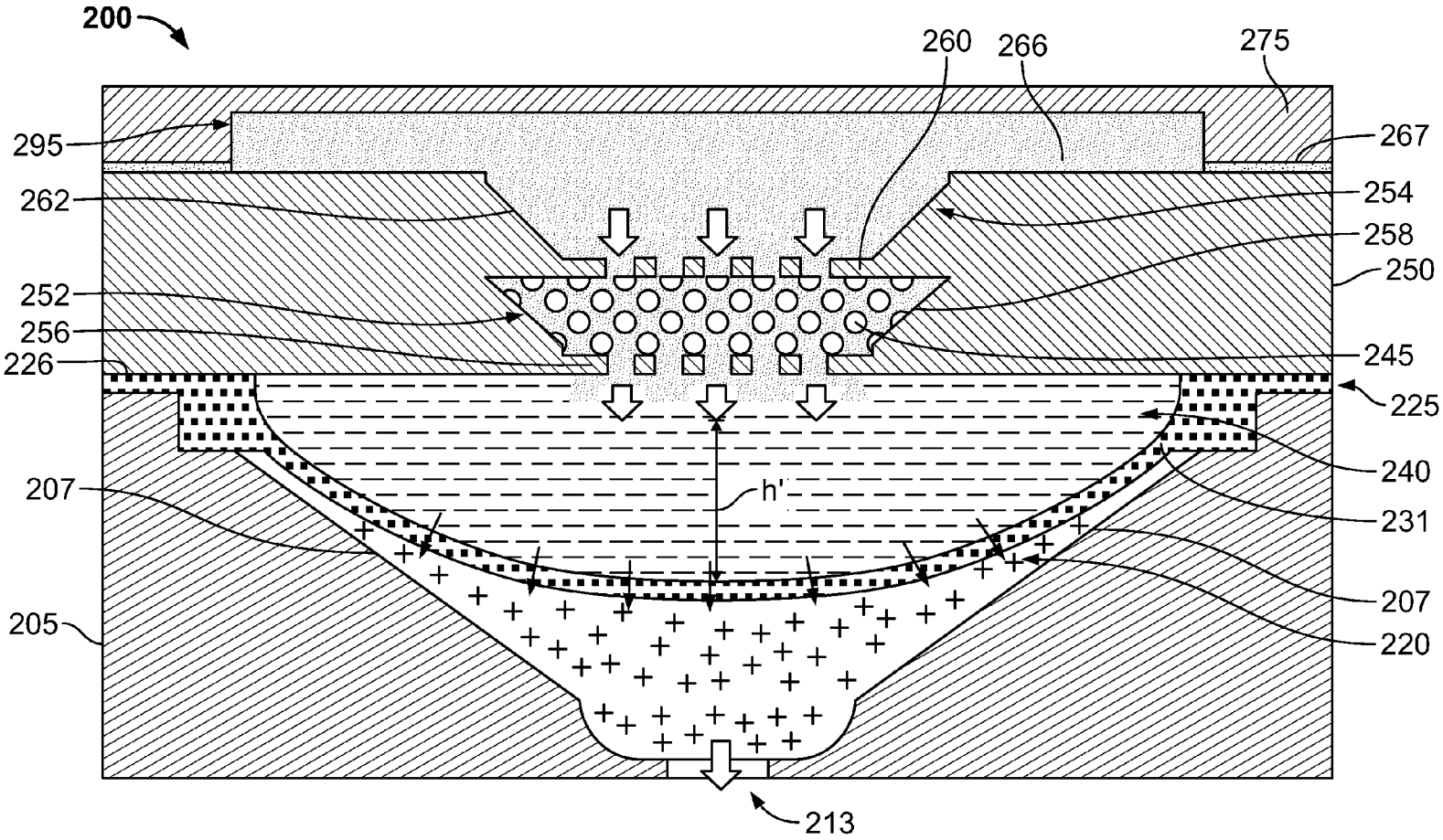
FIG. 2B is a cross-sectional view of a pump in an activated configuration, according to one embodiment.

Referring now to FIGS. 2A and 2B, a pump 200 is shown according to one embodiment. In this embodiment, the pump 200 includes a lower pump body 205 having a conical-shaped cavity defined in part by inner wall 207 for holding a volume of dispensable liquid 220. The liquid can be forced out of the lower pump body 205 via an exit port 213 in a manner described in greater detail herein. The exit port can be plugged with a suitable material, or, alternatively, the plug can include a one-way valve or suitable alternative device to prevent the dispensable liquid 220 from exiting the lower pump body 205 prior to activation of the pump 200. In some embodiments, the exit port 213 can include one or more attachment mechanisms for securely receiving a lumen, tube, or other liquid 220 transporting material so that the dispensable liquid 220 can be delivered to a chosen location when the pump is activated. In some embodiments, the exit port 213 can be a threaded bore configured to receive a corresponding threaded lumen which can be reversibly attached for the purpose of transporting fluid 220 from the lower pump body 205 to a chosen location. In some embodiments, the exit port can be configured to interlock with a device, such as a medical device, which can be configured to receive the fluid 220 for a particular purpose. In one example, the fluid can be an adhesive sealant compound, and the device can be a member of a continent ostomy wafer capable of sealing with, or reversibly sealing with a patient's skin.

In this embodiment, the pump 200 includes a flange member 225 sealingly engaged with the lower pump body 205 and serves, in part, to retain the dispensable fluid 220 within the lower pump body 205 until the pump 200 is activated. The flange member 225 includes a resiliently flexible diaphragm 231 that is capable of being flexed from a first conformation to a second conformation. For example, in this embodiment, the first conformation can be the conformation shown in FIG. 2A, where the diaphragm is substantially flat, and not flexed in the +/−z-direction, which can be a pre-pump activation configuration; the second conformation can be the conformation of the diaphragm shown in FIG. 2B, where the diaphragm is outwardly flexed from its circular midpoint from the first conformation and extends into the conical-shaped cavity of the lower pump body 205 (in the −z direction). The latter conformation, or any conformation where all or part of the diaphragm is stretched or displaced from its equilibrium position, e.g., the first conformation, can be the activated pump conformation.

In this embodiment, the diaphragm 231 is recessed from the top wall 226 of the flange, thereby defining a disk-shaped cavity of height h for storing a layer of expandable material 240 as shown in the pre-pump activation conformation of FIG. 2A. When the pump is activated (described in further detail below) the expandable material 240 can expand, thereby urging all or part of the diaphragm 231 into the conical-shaped cavity of the lower pump body 205 (FIG. 2B). In this and other embodiments, the expandable material layer 240 can be a polymer capable of absorbing a fluid to increase its volume from a first volume to a second, larger volume. In some embodiments, the polymer can be capable of absorbing fluid to increase the volume of the expandable material 240 from a first volume to a second, larger volume, and subsequently releasing fluid to return to approximately the first volume. Exemplary polymers for this purpose include, without limitation, the class of polymers generally known as superporous hydrogels (SPH's) described above.

In this embodiment, an upper pump body 250 is sealingly engaged with the flange member 225 as shown in FIGS. 2A and 2B. The upper pump body 250 includes a lower reservoir 252 which, in this embodiment, has the general shape of an inverted truncated square pyramid as defined by an inner reservoir wall 252. In this embodiment, the lower reservoir 252 includes a porous floor 256 capable of allowing passage of a volume of activation solution 266 therethrough when the pump is activated. In this embodiment, the upper pump body 250 also includes an upper reservoir 254, also having a general shape of an inverted truncated square pyramid as defined by inner reservoir wall 262, for storage of the solution 266. The upper (254) and lower (252) reservoirs are divided by a porous floor 260 configured to allow fluid communication therebetween, as illustrated in FIGS. 2A and 2B.

In this embodiment, the lower reservoir 252 contains a volume of hydrogel beads 245. In this and other embodiments, the hydrogel beads 245 can be size-dependent according to factors (variables) of the surrounding environment, as previously described. In several non-limiting examples, the size, e.g., the mean diameter of the individual hydrogel beads can change according to surrounding temperature, the pH, or ionic strength of the activation solution 266, or other factors. As described herein, thermosensitive hydrogel beads 245 are capable of shrinking or expanding in volume according to temperature. Suitable hydrogel beads 245 include those hydrogel beads described herein and equivalents known in the art. The individual size of the hydrogel beads 245 can be chosen to maximize performance of the pump 200 (as described below) and also in consideration of the pore sizes of the porous floors 256 and 260, so as not to plug the individual pores thereof.

In this embodiment, a pump cover 275 sealingly engages a gasket 267 which serves, in part, to retain the activation solution 266 within the upper reservoir 254 and the void space defined in part by pump cover inner wall 295. The dashed line 290 in FIG. 2A serves to illustrate the base of the inverted truncated square pyramid shape of the upper reservoir 254 and is not a structural component of the pump 200. While not shown in FIGS. 2A or 2B, in this and other embodiments, including the embodiments shown in FIGS. 1A and 1B, the pump cover can include sealable ports for introducing (drawing out) activation solution 266 into (from) the upper reservoir 254 and the void space defined in part by pump cover inner wall 295. Such structure provides the capability to replenish the activation solution 266 if needed, such as after an activation of the pump 200.

Figure 2C:
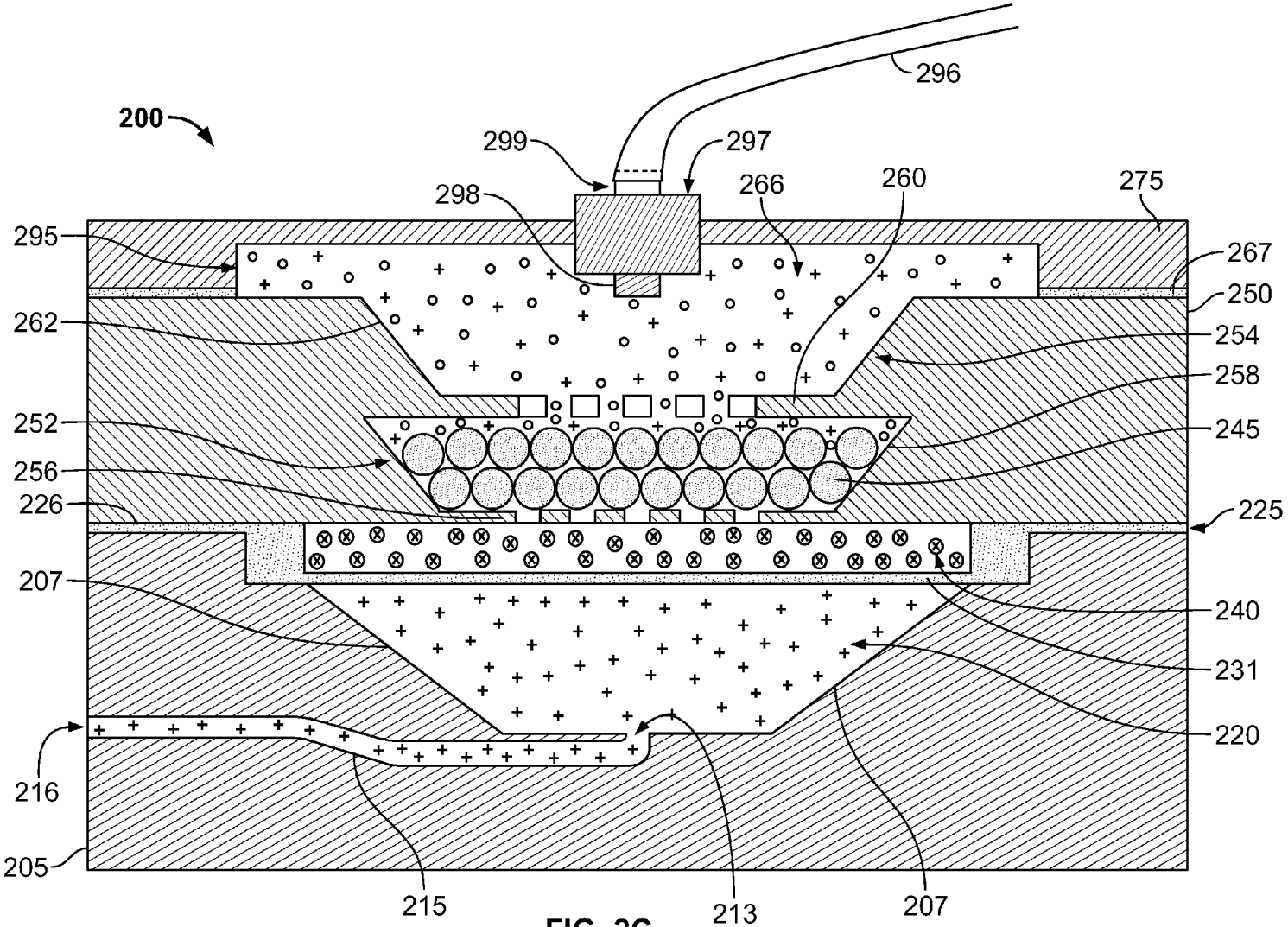
FIG. 2C is a cross-sectional view of a pump in a pre-activated configuration, according to one embodiment.

Referring now to FIG. 2C, in this and other embodiments, pumps of the type described herein can include access ports for delivering fluids, gasses, or other materials into the upper reservoir 254 for activating the pump, or replenishing the activation fluid 266 of the pump 200. The pump 200 shown in FIG. 2C can contain the same structural elements as that described with respect to FIGS. 2A and 2B; in addition, in this embodiment, the pump 200 includes a valve housing 297 configured to sealingly engage with the pump cover 275. In this embodiment, the valve housing 297 houses a one-way valve within the housing (not shown in FIG. 2C for clarity) that allows fluids or gasses to flow into the upper reservoir 254, but restricts flow in the opposite direction. It will be understood that a one-way valve is one of many valve alternatives that can be used to achieve the same or similar functionality in other pump embodiments. In this embodiment, the valve housing 297 further includes a fitting 299 for coupling a terminal end of a lumen 296 to the housing 297. Suitable couplings include, but are not limited to: nipples, plugs, Luer connectors, and plungers. In other embodiments, the fitting 299 can allow a user to inject a solution into the upper reservoir 254 using, e.g., a syringe or similar device. In such cases, the fitting 299 can be a rubber seal or cap. In this embodiment, an output port 298 of the valve housing allows liquids or gasses received via the lumen 296 to enter the upper reservoir 254.

The embodiment of FIG. 2C is one of many examples that can allow a user to activate the pump 200 by administering a liquid or gas into the upper reservoir 254. In such cases, the injected liquid or gas can be one which causes the plug layer, in this case, the hydrogel beads 245 to contract in size, thereby allowing the activation liquid 266 to flow through the porous floors 256, 260, and reach the expandable material layer 240. In another embodiment, the pump can be activated without environmental stimulus by administering a liquid or gas into an empty upper reservoir 254 (e.g., absent hydrogel beads 245). In this embodiment, the introduction of liquid or gas can directly contact the superporous polymer to immediately invoke expansion of the diaphragm 231 into the conical-shaped void and cause corresponding pump operation.

In one embodiment, the hydrogel beads 245 can have a size dependence based on the pH of a surrounding liquid medium. In such an embodiment, the pH of the activation fluid 266 can be changed to activate the pump. For example, at a first activation fluid 266 pH, the hydrogel beads 245 can retain a certain size that substantially precludes the activation fluid from flowing through the porous floors 256, 260; however, at a second activation fluid 266 pH, the hydrogel beads 245 can contract in size, thereby allowing the activation fluid 266 to flow through the porous floors 256, 260 and contact the expandable material layer 240 to activate the pump 200.

In one embodiment, the rate that the activation fluid 266 is exposed to the expandable material layer 240 can be controlled by regulating factors of the environment immediately surrounding the hydrogel beads 245. In one example, consider that the layer of hydrogel beads 245 will contract to a minimum size when the pH of a fluid surrounding the individual beads is 4.0, and that the pump 200 is stored in a non-activated configuration wherein the activation fluid is an aqueous solution having a pH of 7.0. In this example, introducing a highly acidic solution can cause a rapid pH change in, and around the hydrogel beads 245, causing a rapid contraction in size, and a rapid dumping of the activation fluid 266 onto the expandable material layer. In this example, the pump 200 can be expected to rapidly expel the dispensable fluid 220 from the pump 200. However, the rate of pH change can be governed so that the contraction of the hydrogel beads 245 is gradual, instead of rapid, which can lead to a slower activation of the pump 200 and a slower expulsion of the dispensable fluid 220. In one example, a less-acidic solution e.g., a solution of pH 5.0 can be introduced into the upper reservoir 254 to slow the activation of the pump.

In general, components of the pump embodiments described herein can be fabricated from bio-compatible materials. For example, referring back to FIG. 1A, the lower pump body 105, upper pump body 150, cover 175, and any other component can be formed from a bio-compatible plastic so that the pump can be implanted into a human or animal subject. In another example, referring to FIG. 2C in particular, the pump 200 can be formed from a bio-compatible plastic so as to be implantable as just described, wherein the valve housing 297 can be a portal that protrudes out of the skin or other tissue to allow administration of fluids or gasses into the upper reservoir 254 by a physician or other user.

Pump Activation

In general, pumps of the types described herein can be activated using various methods. The choice of method used can depend on material properties of the pump or pump components, in particular, the material properties of hydrogel beads, if incorporated, the intended use of the pump, and other considerations that will be apparent to those skilled in the relevant arts. Reference is made in the following description to components of the pump 200 in FIGS. 2A and 2B, however, it will be understood that the terms and description are equally applicable to other pump embodiments, equivalents, and alternatives, including the embodiment of FIGS. 1A and 1B. As described herein, "activating" the pump 200 refers to one or more steps that result in the dispensable liquid 220 stored in the lower pump body 205 being dispensed from the pump 200 via the exit port 213 (or, in the embodiment of FIGS. 1A and 1B, being dispensed through the aperture 113 of the floor 111, and through the hollow passage 115).

One particular advantage of the concepts provided herein is that the disclosed pumps can be activated without requiring an external power source, such as commercial, residential, or battery-supplied electricity. Although any of the disclosed embodiments can be adapted to use electrical power if desired, in general, the environmental changes that can cause the plug layer or the hydrogel bead layer to contract to activate the pump can be engendered without an external power source.

In general, the operational characteristics of a pump of the type described herein can be dependent on material factors of the pump constituents. Certain uses of a pump may call for rapid expulsion of the dispensable liquid 220, while other uses may benefit from a slow, steady flow of the dispensable liquid 220. The expulsion rate of the dispensable liquid 220 can be dependent on, among other factors, the cross-sectional area the diaphragm, exit port outlet pressure (if regulated by a plug, valve, or other flow-restriction mechanism), and the cross-sectional area of the pump exit port. In general, the maximum operating pressure of a pump of the type described herein can be determined by the force per unit area across the pump diaphragm, which is largely dependent on the expansion rate and volume capacity of the polymer layer adjacent thereto. The amount of fluid absorbed by the polymer can be controlled by the valve action, e.g., the dynamics of the plug layer as it is exposed to environmental stimuli. The pump output flow rate of the dispensable fluid can be affected by the flexibility and pliability of the diaphragm, and the material properties of the fluid, gas or gel, e.g., density, compressibility, volumetric flow rate, etc. The flexibility of the diaphragm can generally be selected by considering the geometry of the diaphragm, e.g., its thickness, the mechanical properties of the diaphragm and the geometry of the fluid-retaining chamber. The elastic modulus and Poisson's ratio are mechanical diaphragm properties that can be considered when designing a pump of the type described herein for a particular use.

In one embodiment, a pump of the type described herein can be thermally activated, e.g., activated by changing the temperature of the pump or one or more of its components. In particular, a pump can be activated by engendering a temperature change to the plug material, e.g., plug material 145 described with respect to FIGS. 1A and 1B, the collection of thermoresponsive hydrogel beads 245 described in FIGS. 2A and 2B, or variants and equivalents thereof. In another embodiment where the plug material of the pump includes pH-sensitive hydrogel beads, the pump can be activated by exposing the hydrogel beads to a solution having a pH that causes the size of the beads to shrink, e.g., by introducing the solution into the upper basket 254 of the upper pump housing 250. In such an embodiment, the pump cover 175 can include an input port capable of receiving fluids from a syringe, catheter tube, or other source. The solution can be introduced manually, or, in some embodiments, as part of a bio-feedback system that monitors an aspect of a patient's physiology and causes the solution to be injected into the pump when certain pre-established criteria are met. In one example, an aspect of a patient's physiology can be a blood sugar concentration, and the solution can be insulin.

In another example, referring to FIG. 2A, the pump 200 can include a plurality of substantially spherical, thermoresponsive hydrogel beads 245 which, at a first temperature, are of an average size to adequately prevent the activation solution 266 from flowing through the porous floor 260 of the upper reservoir 254 into the lower reservoir 252. In one embodiment, the hydrogel beads 245 can have an average diameter that is at least twice the diameter of the pores of the porous floors 260 and 256, assuming substantially equal pore size in both floors.

As described herein, and as known in the art, some thermoresponsive hydrogels are capable of shrinking in average size when heated. Thus, activation of the pump can include engendering a temperature change to the collection of hydrogel beads 245 to cause them to shrink to a size that allows the activation solution 266 to flow from the upper reservoir 254 to the lower reservoir 252, and through the floor (256) of the lower reservoir.

FIG. 2B illustrates the pump 200 in an activated state, where a temperature change has caused the hydrogel beads 245 to shrink in size, which has caused the activation solution 266 to be released from the upper pump body 250 unto the expandable material 240. As previously described, the expandable material 240 can be one which is capable of absorbing all or some of the activation solution 266 which can cause a substantially concurrent increase in volume, as previously described. Comparing the illustrated volume of the expandable material 240 in FIGS. 2A and 2B, it can be seen that the absorption of the solution 266 causes significant swelling of the expandable material 240 when the pump is activated. The swelling of the material 240 creates outward expansion force in all directions; however, the upper pump body 250 can be composed of a rigid or semi-rigid material such as PMMA that resists the expansion force and urges the material and the diaphragm 231 into the conical-shaped cavity of the lower pump body 205 as illustrated in FIG. 2B. In this embodiment, the expansion force of the expandable material 240 urges the dispensable fluid 220 to the exit port 213, where it can be channeled or flowed to a desired location as explained herein.

In general, a pump of the type described herein can be activated in accordance with the above description by various methods. In one non-limiting example, a pump can be activated through application of a heat source to the body of the pump. The solid components of a pump, e.g., the lower pump body 205, upper pump body 250, and pump cover 275 can be formed from a material having a desired amount of thermal conductivity. In some cases, it can be beneficial to form the solid components from a material having a high thermal conductivity, e.g., in situations where the desired reaction time of pump activation is relatively fast. In other cases, however, it can be beneficial to form the solid components from a material having a lower degree of thermal conductivity, so that accidental or unintended activation of the pump is not caused by ambient temperature fluctuations.

In general, a pump of the type described herein can be configured to protect the inner components and cavities (e.g., the conical-shaped cavity of the lower pump housing 205, diaphragm 231, lower (252) and upper (254) reservoirs, expandable material 240, and hydrogel beads 245) from outside sources of moisture or other fluids. In other words, the pump can be substantially impervious to water and other fluids.

In general, the rate at which the dispensable fluid is dispensed from pumps of the type described herein can be controlled according to one or more material considerations. In a first material consideration, the plug layer material (145, FIGS. 1A and 1B) or the hydrogel beads (245, FIGS. 2A and 2B) can be chosen for their degree of thermoresponsiveness. Without wishing to be bound by theory, it is presumed that materials having a higher degree of thermoresponsiveness will generally respond more quickly to temperature changes of the ambient surroundings and vice-versa. In another consideration, the material and mechanical characteristics of the diaphragm can affect the expansion rate of the expandable polymer layer (e.g., polymer layer 140). In general, with all other factors equal, a thinner diaphragm can be urged into the conical-shaped cavity of the lower pump body 105 by the expandable polymer (when activated) faster than a diaphragm having a relatively greater thickness. In general, a diaphragm having a higher degree of elasticity can provide the flexibility to exert higher output compression forces. Additionally, the diaphragm can be formulated from rubber or other compounds having a desired degree of elasticity for a particular purpose or application.

In general, any type of SPH can be incorporated as, or in the plug layer 145 or the thermosensitive hydrogel beads 245 as described above with respect to FIGS. 1A-2B for actuating the pump. In one approach, a SPH polymer with additional monomer, e.g., about 0.877% additional monomer can be used. In another approach, a superporous hydrogel with an interpenetrating polymer network (SPIH) can be used, which incorporates a second polymer network inside of an SPH to strengthen the polymer structure. SPIH hydrogels can have enhanced mechanical properties compared with SPHs, including higher compression strength and elasticity, making them a potential candidate for use as a pump actuator. The enhanced properties may be attributable to scaffold-like fiber network structures formed inside the cell walls of SPHs.

In general, the various components of a pump of the type described herein can be composed of various materials known in the art, the choice of which may depend on one or more considerations, including: cost, including manufacturing and raw material cost, disposability of the pump, operability, ruggedness, resistance to degradation from heat, radiation, chemicals, or aesthetic value.

In general, some pump applications—e.g., wound therapy applications—can benefit from a pulsed delivery of the dispensable fluid. In some embodiments, a pump of the type described herein is capable of producing a pulsed output, e.g., a controlled flow of the dispensable fluid for a certain period of time, followed by an "off" period, followed again by an "on" period of the controlled flow. Pulsed dispensable fluid output can be achieved, among other approaches, through application of periodic environmental stimulus to the plug layer, or by manually introducing pressure to one of the pump chambers, e.g., upper basket 154 or lower basket 152 using, e.g., a syringe to deliver gas or liquid as previously described.

In one embodiment, a pump of the type described herein can contain an activation solution within a burstable pouch or similar type of container. The activation solution can be in fluid communication with the plug layer, e.g., plug layer 145 when the pouch is broken, and the pouch can be caused to burst by force or other methods when desired by the user. Referring back to FIG. 1A, in one example, the pump 100 can include a burstable pouch of activation solution 166 positioned in the upper basket 154. The cover 175 and the gasket 167 can be flexible, so that a user can push down on the top of the pump 100 to cause the burstable pouch to burst, thereby releasing the activation solution, which can cause the pump to activate and release the dispensable fluid 120 as previously described. Such an embodiment can have particular advantages for remote use when access to environmental stimulus of the type described herein is unavailable, e.g., in military combat situations where soldiers may have limited resources.

In some pump embodiments, e.g., embodiments where the pump is configured for remote or body-worn use, the use of lab-on-a-chip technology can be incorporated into the pump design for sampling body fluids or other physiological measurements. In one such embodiment, the power source for the lab-on-a-chip assembly (not shown in FIGS. 1A-9) can be an air-bursting detonator. An air bursting detonator can supply energy by releasing stored gas when triggered by a short electrical pulse, as described, e.g., in "Disposable Smart Lab on a Chip for Point-of-Care Clinical Diagnostics," C. H. Ahn et al., Proc. IEEE Vol. 92 (1), January 2004, 154; and U.S. Pat. No. 7,524,464 entitled "Smart disposable plastic lab-on-a-chip for point-of-care testing" to Ahn et al., which is incorporated herein in its entirety by reference for all purposes.

In some pump embodiments, particularly those embodiments incorporating lab-on-a-chip technology as previously described, surface energy gradient dispensing methods can be used to improve flow properties of fluids. Such methods can be advantageous for reducing the energy required to transport fluids, enhance droplet formation, directing the movement of droplets, facilitate mixing of on-chip reagents or compositions, promoting sensory reactions, e.g., controlling the rate of diffusion in, e.g., glucose sensing, reducing variability in sampled fluid volumes and flows, etc. One exemplary surface energy gradient dispensing method is described in U.S. Pat. No. 7,790,265 to Brian Babcok, entitled "Surface-energy gradient on a fluid-impervious surface and method of its creation using a mixed monolayer film," which is incorporated in its entirety herein by reference for all purposes.

EXAMPLE

The following example is illustrative only; the materials and methods used in carrying out the experiments and the measured characteristics of the pump are in no way limiting with respect to the inventive concept or the claims.

A pump similar to that shown in FIGS. 1A and 1B was assembled and included: a lower pump body composed of PMMA, which included a conical-shaped chamber for storing a solution of a sealant fluid and an exit nozzle capable of discharging the sealant fluid when the pump was activated. A 100 kPa silicon pressure sensor (MPX 100, Motorola, Inc.) was used to measure pump exit pressure. A natural latex rubber diaphragm composed of a 270 μm thick elastic membrane sealed the sealant fluid within the conical-shaped chamber as previously described. A layer of NIPAAm expandable polymer having a weight of approximately 0.2 grams was applied to the top side of the diaphragm. An upper pump body was sealingly engaged to the flange; the upper pump body stored an aqueous activation solution that was released to the NIPAAm layer when the one-way valve was opened. The pump was activated using a one-way valve (Model No. F-2804-403, Pneuaire, Inc.) that was mounted in an upper pump body to simulate activation by hydrogel beads (245, FIGS. 2A-2B). The upper pump body was sealingly engaged to the flange. The assembled pump measured 16 mm×16 mm×14.8 mm, and had a fluid capacity of 3.0 mL.

Figure 3:
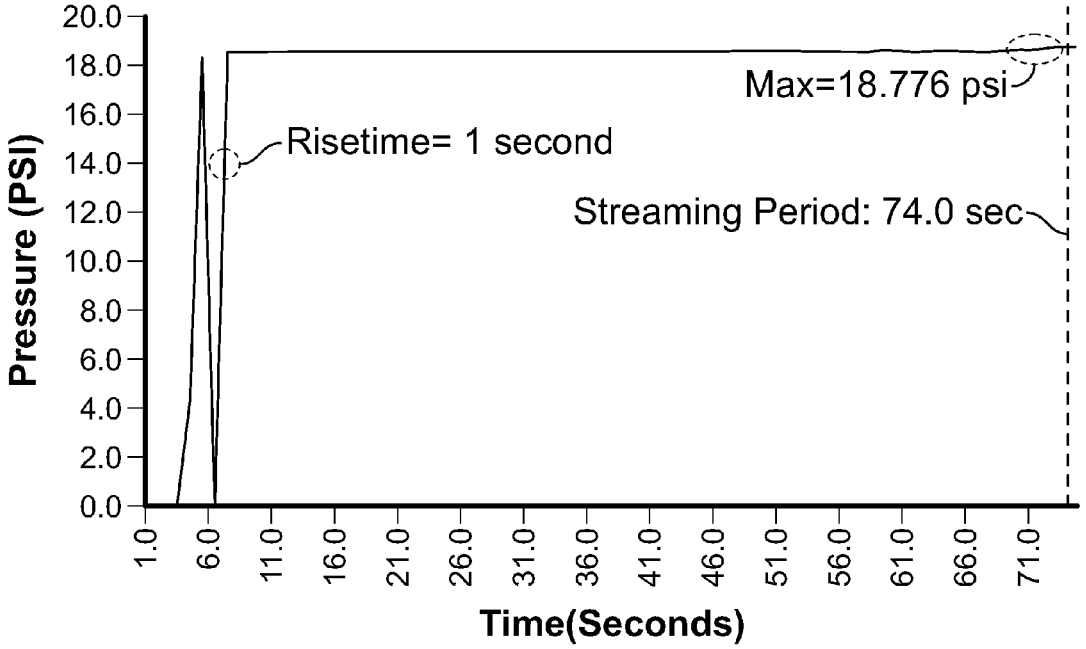
FIG. 3 is a chart showing measured pump output pressure versus time.

Referring now to FIG. 3, a graph showing measured pump pressure output vs. time is shown. The graph illustrates short-duration pump streaming characteristics, marked by a rapid pressure rise time of approximately one (1) second, and a holding pressure of approximately 18.776 psi for a period of at least 71 seconds.

Figure 4:
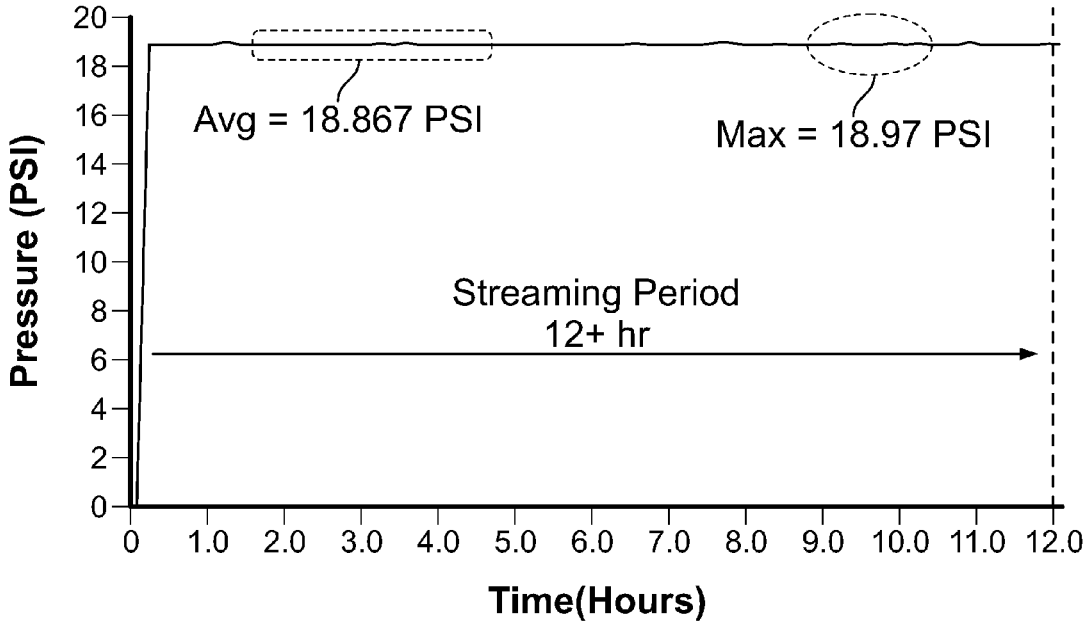
FIG. 4 is a chart showing measured pump output pressure versus time.

Referring now to FIG. 4, a graph showing measured pump pressure output vs. time is shown. The graph illustrates long-duration pump streaming characteristics, marked by a rapid pressure rise time of approximately one (1) second, and a holding pressure of approximately 18.867 psi for a period of greater than 60 hours.

Figure 5:
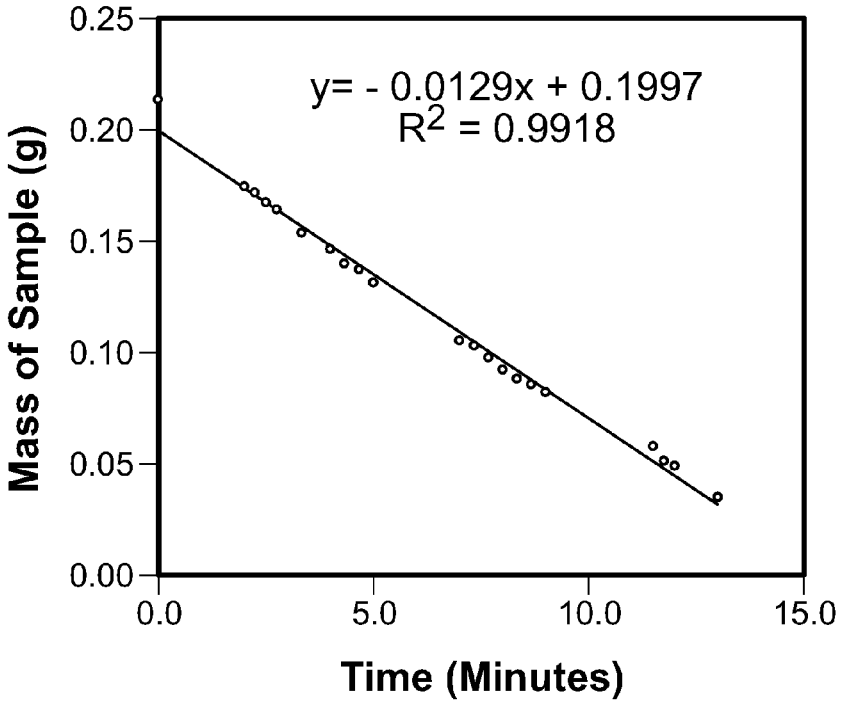
FIG. 5 is a chart showing sample mass versus time.
Figure 6:
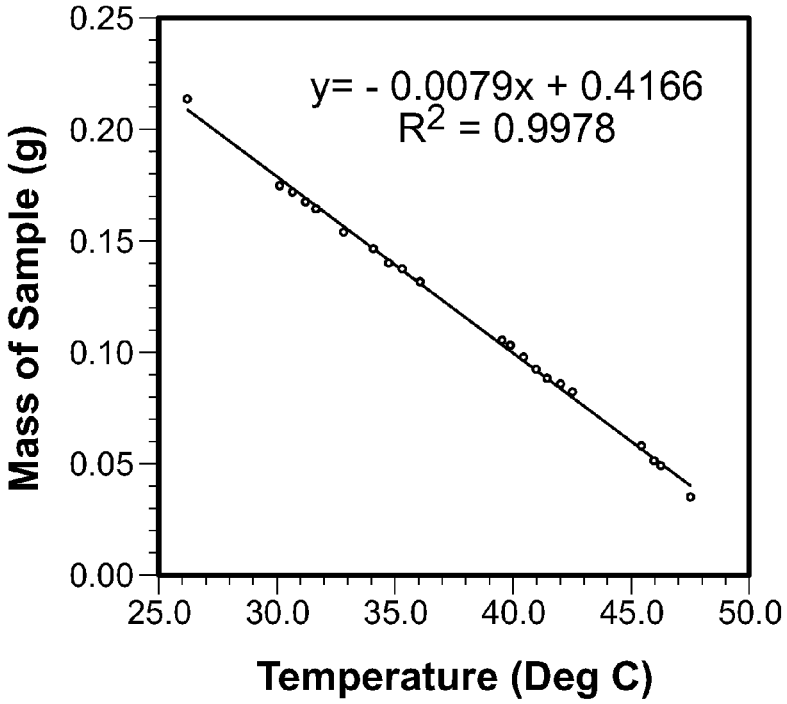
FIG. 6 is a chart showing sample mass versus temperature.

Referring now to FIGS. 5 and 6, the swelling kinetics of the NIPAAm hydrogel is shown. The charts illustrate the time- and temperature-dependent swelling characteristics of the NIPAAm hydrogel which can be used as a pump activator (e.g., the plug layer 145 in FIGS. 1A-1B, or the hydrogel beads 245 in FIGS. 2A-2B). The hydrogel was a clear gel synthesized by combining 6 mL of N-isopropyl acrylamide (NIPAAm), 6 mL of acrylic acid, 6 mL of N—N'-methylene bisacrylamide (a cross-linking agent), 1 mL of ammonium persulfate, and 100 μL of tetramethylenediamine. The kinetics of swelling (i.e. de-swelling for pump operation) of these hydrogels are relatively fast, capable of losing approximately 85% of water mass over a period of about 13 minutes and a concurrent temperature increase of approximately 21° C. The kinetics of the swelling or de-swelling can be controlled in part by varying the cross-linker density of the NIPAAm hydrogel.

As described above, a pump of the type described herein can be activated by a variety of environmental stimuli to the plug layer (e.g., plug layer 140 or the hydrogel beads 240 described above). In one pump embodiment, the pump can be activated by exposing the hydrogel beads to a solution having a pH that causes the beads to contract; the pump can be activated in a similar manner to those described above that are activated by thermo-sensitive hydrogel beads.

Figure 7:
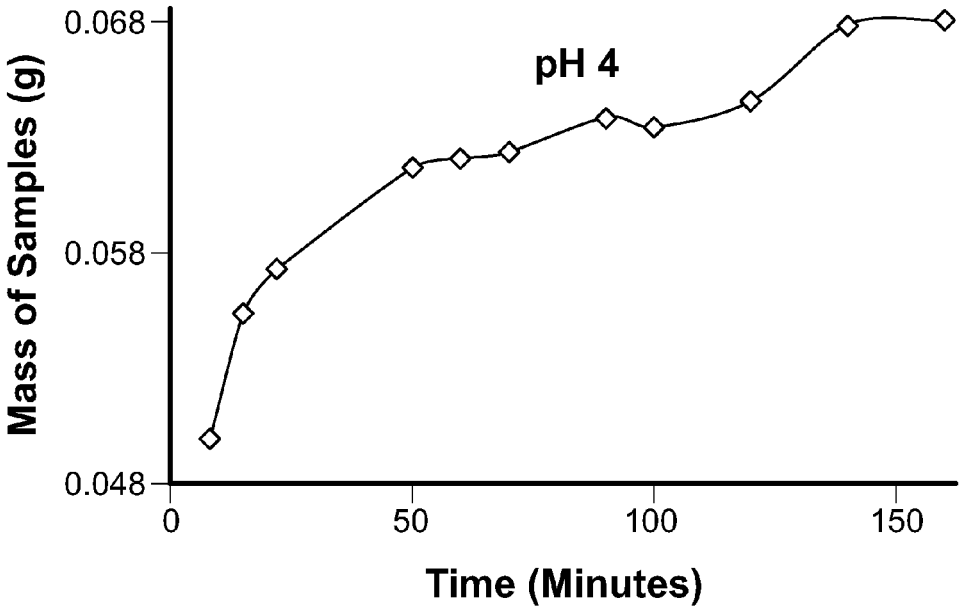
FIG. 7 is a chart showing sample mass versus time at pH 4.0.
Figure 8:
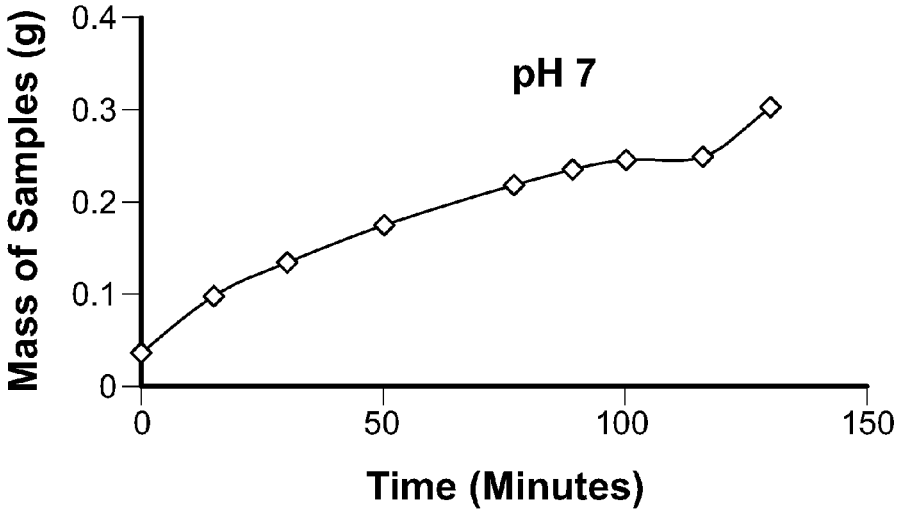
FIG. 8 is a chart showing sample mass versus time at pH 7.0.
Figure 9:
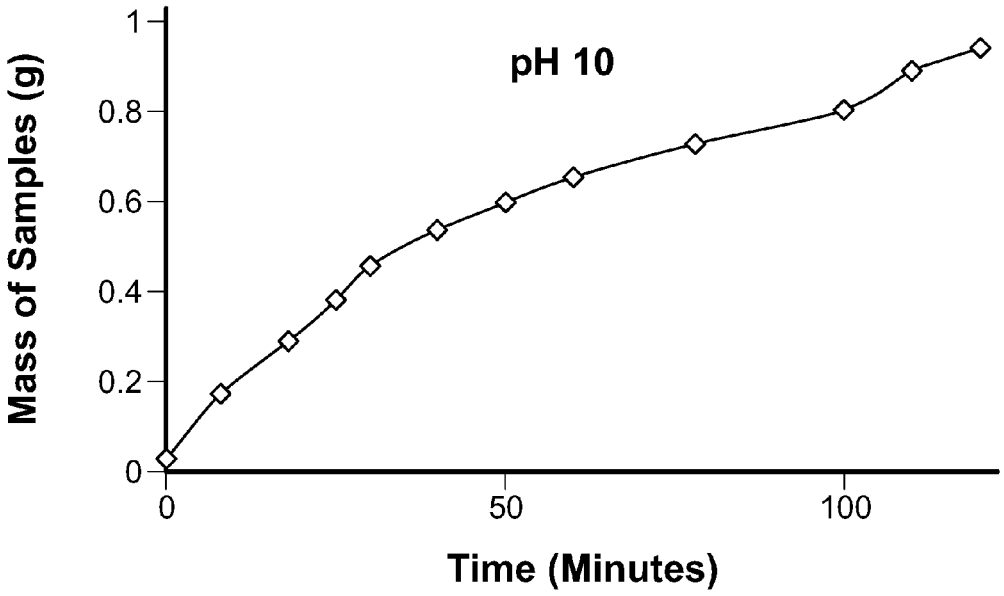
FIG. 9 is a chart showing sample mass versus time at pH 10.0.

Referring now to FIGS. 7, 8 and 9, swelling data for NIPAA copolymer hydrogels are shown. The extent and kinetics of NIPAA swelling appear to be pH-dependent, where, without wishing to be bound by theory, the characteristics can be attributed to the presence of acrylic acid component in the hydrogel chain. The extent of swelling and the kinetics of swelling increases with pH over comparable period of time. The extent of volume swelling at pH 4, pH 7 and pH 10 after 100 minutes of equilibration of the dried copolymeric NIPAA hydrogels in aqueous solution are 27%, 565% and 2407% respectively.

A number of illustrative embodiments have been described. Nevertheless, it will be understood that various modifications may be made without departing from the spirit and scope of the various embodiments presented herein. For example, it may be advantageous in some circumstances to modify or adapt certain components for a particular use. Similarly, it may be advantageous to supplement certain components with other components for various reasons which will be apparent to those skilled in the art. It may be advantageous to perform steps disclosed herein in a different order, or elect not to practice certain steps under certain circumstances or for particular reasons. For example, pumps of the type described herein can be re-used after activation. In one such approach, a pump can be dried to remove activation liquid absorbed in the polymer layer so that the polymer layer shrinks back to a pre-activation configuration. Additional activation solution can be re-loaded, in some embodiments, to the upper basket, e.g., the upper basket 154 in FIG. 1A, so that the pump can be activated again, or a plurality of times. Mechanical valves can be used to drive activation fluid to the polymer layer as an alternative to the hydrogel valves described herein; thus, pumps according to such an embodiment can be activated manually or by controlling the mechanical valves to activate the pump. In one embodiment of a miniature pump, the dispensable fluid, e.g., dispensable fluid 120 in FIG. 1A is a liquid sealant that can be used to seal a negative wound pressure therapy wound dressing or ostomy wafer. In one embodiment, a pump of the type described herein can be assembled into an operative configuration using ultrasonic welding techniques known in the art.

Miniature pumps such as those described herein can have additional uses beyond what has been described herein. It will be understood that the functionality of the disclosed pumps can be accomplished using the disclosed components; however, those components can be scaled, modified, or adapted to fit other uses. For example, a miniature pump can be used in the practice of balloon angioplasty. In such a use, a pump having features similar to those described herein can be routed through a catheter to a treatment site, e.g., an arterial or venous blockage or damage site. In this embodiment, the pump can be configured to pump air or another gas to an angioplasty balloon, which may be connected directly to an exit port of the pump or remotely positioned on a guide catheter or other instrument. The pump can be triggered by an environmental stimulus, such as a magnetic field, electrical current, or other stimulus, to cause the pump to activate and thereby inflate the balloon so that a medical procedure such as arterial repair can be performed. Micromachining techniques can be used in this and other embodiments to manufacture pump components on a scale suitable for angioplasty or other medical procedures, or according to a particular intended use.

Various embodiments may include structures or compositions, or combinations thereof for activating a miniature pump. For example, referring to FIGS. 1A and 1B, the upper pump body 150 includes upper basket 154 and lower basket 158; the upper basket 158 includes an activation solution 166 which can be released upon the expandable polymer layer 140 when the plug layer 145 responds to an environmental stimuli. For example, the plug layer 145 can shrink in size in response to externally-applied heat. The expandable polymer layer 140 can expand in size when it is exposed to the activation solution 166. As described herein, the expansion of the polymer layer 140 can urge the diaphragm 131 into the confines of the lower pump body chamber 107 and thereby force the dispensable fluid 120 out of the pump 100 via the hollow passage 115 and outlet port 116. Other structures or compositions, or combinations thereof are described herein and will be apparent to those skilled in the art.

Accordingly, other embodiments are within the scope of the following claims.

What is claimed is:

1. A pump, comprising:

a first pump body having a chamber for storing a flowable substance and one or more exit ports in fluid communication with said chamber, through which said flowable substance can be dispensed when said pump is activated;

a flexible diaphragm sealingly engaged to said first pump body and positioned to retain said flowable substance within said chamber when said pump is in a pre-activation configuration;

a layer of absorbent material disposed upon a surface of said diaphragm opposite said chamber; and a second pump body sealingly engaged to said first pump body having first and second chambers connected by a porous wall that, when said pump is activated, allows a stored activation fluid to flow from said first chamber through said second chamber, and onto said layer of absorbent material to cause said layer of absorbent material to swell in size;

wherein said swelling of said absorbent material causes said diaphragm to flex into said first pump body chamber and thereby urge said flowable substance toward said one or more exit ports.

2. The pump according to claim 1, wherein said flowable substance is a liquid, gel, or gas.

3. The pump according to claim 1, further comprising:

a plug layer disposed within said second chamber of said second pump body and retained therein in part by a porous chamber floor, wherein said plug layer substantially prevents said activation fluid from flowing from said first chamber through said second chamber until said pump is activated.

4. The pump according to claim 3, wherein said plug layer comprises an environmentally-responsive polymer that undergoes a change in size according to one or more environmental stimuli.

5. The pump according to claim 4, wherein said one or more environmental stimuli is one or more of a change in: temperature, pH, pressure, salinity, ionic strength, or exposure to radiation.

6. The pump according to claim 5, wherein a change in said temperature is caused by vibration-induced friction between components of said environmentally-responsive polymer.

7. The pump according to claim 3, wherein said plug layer comprises a hydrogel.

8. The pump according to claim 7, wherein said hydrogel is a plurality of hydrogel beads.

9. The pump according to claim 8, wherein said hydrogel beads are formed of N-isopropylacrylamide.

10. The pump according to claim 1, wherein said layer of absorbent material comprises a superporous hydrogel or superporous hydrogel beads.

11. The pump according to claim 1, wherein a dispensing rate of said flowable substance is selectably controlled by one or more of: the thickness and material composition of said diaphragm; a reaction rate of said absorbent material to an environmental stimuli; or an absorption rate of said activation fluid into said absorbent material.

12. A pump for dispensing a stored fluid, gas or gel, comprising:

a pump body having a first retaining chamber for retaining said stored fluid, gas or gel defined by one or more inner walls, a floor adjacent to said one or more inner walls, and a flexible diaphragm, wherein said flexible diaphragm is capable of extending into said fluid retaining chamber under an urging force provided by expansion of an absorbent material layer disposed on a surface of said diaphragm opposite of said fluid-retaining chamber to cause said fluid, gas or gel to be dispensed from said pump body through one or more exit channels that extend from said chamber to an exterior portion of said pump body; and a pump activator comprising an activation solution contained in a storage chamber capable of causing said absorbent material layer to expand in volume when received and absorbed by said absorbent material layer, and a plug layer interposed between said storage chamber and said absorbent material layer capable of substantially preventing said activation solution from contacting said absorbent material layer under a first environmental condition, and allowing said activation solution to flow to said absorbent material layer under a second, different environmental condition.

13. The pump according to claim 12, wherein said first or said second environmental condition is one or more of temperature, pH, pressure, ionic strength, salinity, or exposure to electromagnetic radiation.

14. The pump according to claim 12, wherein said plug layer comprises a plurality of hydrogel beads.

15. The pump according to claim 14, wherein said storage chamber and said absorbent material layer are separated by a porous wall having pores that are smaller in diameter than the mean diameter of said hydrogel beads.

16. The pump according to claim 14, wherein said hydrogel beads are formed of N-isopropylacrylamide.

17. The pump according to claim 12, wherein said absorbent material layer comprises a superporous hydrogel or superporous hydrogel beads.

18. The pump according to claim 12, wherein said fluid, gas or gel comprises an effective dose of a therapeutic agent for treating an illness or disease, or cleansing a wound or surgical site.

19. The pump according to claim 12, wherein said fluid, gas or gel comprises or one or more polymeric solutions for the positioning or separation of animal tissue.

20. A miniature pump, comprising:

a lower pump body configured to hold a flowable substance in a storage chamber having one or more exit ports through which said flowable substance can flow out of said pump when said pump is activated;

a flexible diaphragm adjacent said storage chamber configured to shift between a substantially non-flexed configuration and a flexed configuration that causes said flowable substance to be expelled from said storage chamber; and an upper pump body adjacent said lower pump body comprising means for retaining a stored activation solution under a first environmental condition and releasing said stored activation onto an expandable layer adjacent said flexible diaphragm under a second, different environmental condition;

wherein said expandable layer is configured to cause said flexible diaphragm to shift to said flexed configuration upon receiving said activation solution.

* * * * *